US010882176B2

(12) United States Patent
Fuchs

(10) Patent No.: US 10,882,176 B2
(45) Date of Patent: Jan. 5, 2021

(54) HAND-HELD MACHINE TOOL COMPRISING A CLAMPING COLLAR

(75) Inventor: Rudolf Fuchs, Neuhausen (DE)

(73) Assignee: Robert Bosch GmbH, Stuttgart (DE)

( * ) Notice: Subject to any disclaimer, the term of this patent is extended or adjusted under 35 U.S.C. 154(b) by 1176 days.

(21) Appl. No.: 13/818,411

(22) PCT Filed: Jul. 27, 2011

(86) PCT No.: PCT/EP2011/062918

§ 371 (c)(1),
(2), (4) Date: Jun. 11, 2013

(87) PCT Pub. No.: WO2020/025324

PCT Pub. Date: Mar. 1, 2012

(65) Prior Publication Data

US 2014/0144655 A1 May 29, 2014

(30) Foreign Application Priority Data

Aug. 23, 2010 (DE) ..... 10 2010 039 637

(51) Int. Cl.

| | |
|---|---|
| ***B25F 5/00*** | (2006.01) |
| ***B27B 19/00*** | (2006.01) |
| ***B24B 27/08*** | (2006.01) |
| ***B24B 23/04*** | (2006.01) |

(52) U.S. Cl.

CPC ..... *B25F 5/00* (2013.01); *B24B 23/04* (2013.01); *B24B 27/08* (2013.01); *B27B 19/006* (2013.01)

(58) Field of Classification Search

None

See application file for complete search history.

(56) References Cited

U.S. PATENT DOCUMENTS 2,545,659 A * 3/1951 Ginter ..... B23B 45/001 15/143.1
3,148,568 A * 9/1964 Hoza ..... B25F 5/026 294/31.2

(Continued)

FOREIGN PATENT DOCUMENTS

CN 1239912 A 12/1999
CN 1535794 A 10/2004

(Continued)

OTHER PUBLICATIONS

International Search Report corresponding to PCT Application No. PCT/EP2011/062918, dated Dec. 5, 2011 (German and English language document) (5 pages).

*Primary Examiner* — Hemant Desai
*Assistant Examiner* — Tanzim Imam
(74) *Attorney, Agent, or Firm* — Maginot, Moore & Beck LLP

(57) ABSTRACT

The disclosure relates to a hand-held machine tool, comprising a housing and a drive unit, a gearbox unit which is provided to convert a rotary motion of the drive unit into an oscillating motion and has an output shaft, and a tool holder for fastening at least one tool, said tool holder being drivable in an oscillating manner via the output shaft the gearbox unit. According to the disclosure, the hand-held machine tool comprises a clamping collar, which extends in a circumferential direction at least partially around the output shaft.

7 Claims, 4 Drawing Sheets

(56) References Cited

U.S. PATENT DOCUMENTS 3,537,336 A * 11/1970 Schmuck ..... B23B 49/006 173/21
3,899,852 A * 8/1975 Batson ..... B24B 23/022 451/359
4,008,720 A * 2/1977 Brinckmann ..... B23D 59/02 30/123.3
4,368,556 A * 1/1983 Wanner ..... B23B 45/001 16/436
4,729,194 A * 3/1988 Maier ..... B24B 23/04 451/357
4,820,090 A * 4/1989 Chen ..... B25F 5/027 16/431
4,891,915 A 1/1990 Yasuda
4,905,420 A * 3/1990 Flachenecker ..... B24B 55/105 451/344
5,049,012 A * 9/1991 Cavedo ..... B25F 5/026 16/426
5,957,765 A * 9/1999 Kimbel ..... B23D 67/06 451/356
6,464,573 B1 * 10/2002 Keller ..... B23Q 11/06 451/359
6,595,300 B2 * 7/2003 Milbourne ..... B25B 21/00 16/431
6,863,479 B2 * 3/2005 Frauhammer ..... B25D 17/043 16/426
2002/0101311 A1 * 8/2002 May, III ..... B25B 11/002 335/205
2002/0193055 A1 * 12/2002 Tiede ..... B24B 21/04 451/57
2004/0012160 A1 * 1/2004 Krondorfer ..... B24B 45/006 279/9.1
2005/0095966 A1 * 5/2005 Jasch ..... B23B 31/008 451/342
2008/0169114 A1 * 7/2008 Wuensch ..... B24B 23/04 173/198
2008/0200103 A1 * 8/2008 Esenwein ..... B24B 55/052 451/455
2009/0197514 A1 * 8/2009 Peisert ..... B23Q 5/027 451/356
2010/0197208 A1 * 8/2010 Blickle ..... B24B 23/02 451/342
2011/0036609 A1 * 2/2011 Blickle ..... B24B 23/028 173/213
2011/0072946 A1 * 3/2011 Bernardi ..... B25F 5/00 83/522.11

FOREIGN PATENT DOCUMENTS

CN 1729081 A 2/2006
CN 101534999 A 9/2009
CN 101790436 A 7/2010
DE 103 16 182 A1 10/2004
DE 10 2006 053 301 A1 5/2008
EP 0 301 269 A2 2/1989
EP 1 358 964 A1 11/2003
GB 2408709 A * 6/2005 ..... B24B 23/02
RU 2 152 862 C2 7/2000
SU 716192 A1 2/1980
SU 716762 A1 2/1980
SU 854691 A1 8/1981
WO WO 2009086594 A1 * 7/2009 ..... B24B 23/022

* cited by examiner

HAND-HELD MACHINE TOOL COMPRISING A CLAMPING COLLAR

This application is a 35 U.S.C. § 371 National Stage Application of PCT/EP2011/062918, filed on Jul. 27, 2011, which claims the benefit of priority to Serial No. DE 10 2010 039 637.0, filed on Aug. 23, 2010 in Germany, the disclosures of which are incorporated herein by reference in their entirety.

BACKGROUND

The disclosure relates to a hand-held machine tool as described herein.

A hand-held machine tool comprising a housing and a drive unit, comprising a gearbox unit, which is designed to convert a rotary motion of the drive unit into an oscillating motion and has an output shaft, and comprising a tool holder for the fastening of at least one insert tool, which tool holder can be driven in an oscillating manner via the output shaft of the gearbox unit, is already known.

SUMMARY

The disclosure relates to a hand-held machine tool comprising a housing and a drive unit, comprising a gearbox unit, which is designed to convert a rotary motion of the drive unit into an oscillating motion and has an output shaft, and comprising a tool holder for the fastening of at least one insert tool, which tool holder can be driven in an oscillating manner via the output shaft of the gearbox unit.

It is proposed that the hand-held machine tool has a clamping collar, which extends at last partially around the output shaft in a peripheral direction. By a "clamping collar" should be understood in particular, in this context, a component which is designed to receive and support an accessory mounting device, preferably in a positive and/or non-positive locking manner, and which extends preferably at an angle other than 0°, and preferably at an angle greater than 45°, and particularly preferably at least substantially perpendicular to a direction of principal extent of the hand-held machine tool, and/or extends substantially parallel to the output shaft of the gearbox unit. By "substantially" should here be understood, in particular, that a deviation of an actual angle from a predefined angle amounts, in particular, to less than 25%, preferably to less than 15%, and particularly preferably to less than 5% of the predefined angle. By "designed" should specifically be understood, in particular, contrived and/or equipped. By virtue of the clamping collar disclosed herein, an advantageously simple reception of an accessory part for the hand-held machine tool can be achieved, whereby, in particular, the ease of operation for a user of the hand-held machine tool can be advantageously enhanced. Furthermore, by means of the clamping collar disclosed herein, it can be achieved in an advantageously simple manner that an accessory mounting device can be fastened to the clamping collar preferably in at least two different positions relative to the peripheral direction of the clamping collar, whereby a flexibility of the hand-held machine tool can advantageously be increased.

In a particularly preferred embodiment of the disclosure, the clamping collar is preferably configured in one piece with a housing of the hand-held machine tool, which housing is formed, in particular, of a plastic. By "in one piece" should be understood, in particular, "formed on", such as preferably by the production of a casting and/or by production in a single-component or multi-component injection moulding process. As a result, a particularly advantageously simple and cost-effective production of the hand-held machine tool with clamping collar can be achieved. It is also conceivable, however, to fasten the clamping collar differently in an integrally bonded manner to the housing of the hand-held machine tool, such as, in particular, by gluing and/or welding. It is likewise conceivable to fasten the clamping collar to the, in particular, plastic-formed housing of the hand-held machine tool in a different manner which appears sensible to a person skilled in the art, such as, in particular, in a non-positive-locking manner by pressing of the clamping collar into the housing of the hand-held machine tool and/or in a positive-locking manner by a screw joint.

It is also conceivable to produce the clamping collar from a metallic material. As a result, the clamping collar can advantageously be of stable and robust configuration. The clamping collar formed of a metallic material can preferably be encased by the housing of the hand-held machine tool, which housing is formed, in particular, of a plastic. It is also conceivable to fasten the clamping collar differently in an integrally bonded manner to the housing of the hand-held machine tool, such as, for example, by gluing, welding, etc. Other embodiments of the clamping collar which appear sensible to a person skilled in the art, and the fastening of the said clamping collar to the housing of the hand-held machine tool, are also conceivable, however.

It is proposed that the clamping collar is arranged at a distance from a machining-side-facing end of the housing in a direction of principal extent of the housing that is facing away from the machining side. By "a machining-side-facing end of the housing" should be understood, in particular, an end region of the housing of the hand-held machine tool, which end region, in the direction of principal extent of the hand-held machine tool, is arranged facing the tool holder. That end of the housing which is facing the machining side comprises an end face which preferably stands, at least in part, at least substantially perpendicular, i.e. with a deviation less than 45°, preferably less than 20°, to the direction of principal extent, and which forms a, in the direction of principal extent, outermost region of the housing of the hand-held machine tool. By "arranged at a distance from" should be understood, in particular, in this context that a surface formed in particular, by a bottom side of the housing is arranged between the end face of the machining-side-facing end of the hand-held machine tool, which end face extends at least substantially perpendicular to the direction of principal extent of the hand-held machine tool, and at least one point of intersection of a shell surface of the clamping collar and a vector running, starting from a rotational axis of the output shaft, in the direction of the end face parallel to the direction of principal extent, wherein a surface normal of the surface, which is preferably formed by the bottom side of the housing of the hand-held machine tool, runs at least substantially parallel to the output shaft of the gearbox unit. By "substantially" should here be understood, in particular, that a deviation in parallelism of the surface normal of the surface formed by the bottom side of the housing and of the output shaft of the gearbox unit amounts, in particular, to less than 25°, preferably to less than 15°, and particularly preferably to less than 5°. Preferably, the clamping collar is enclosed, in particular fully, by the surface running at least substantially perpendicular to the axial direction of the output shaft, which surface is preferably formed by the bottom side of the housing. By virtue of the embodiment disclosed herein, a particularly advantageous reception of the accessory mounting device on the clamping collar can be achieved.

It is further proposed that the clamping collar, in an axial direction of the output shaft, has a length of at least 3 mm. In a particularly preferred embodiment of the disclosure, the clamping collar, in the axial direction of the output shaft, has a length of at least 5 mm, preferably at least 8 mm, and particularly preferably at least 10 mm. It can thereby be achieved that the accessory mounting device can be fastened to the clamping collar of the hand-held machine tool by the user of the hand-held machine tool in an advantageously simple and comfortable manner.

In a further embodiment of the disclosure, it is proposed that the clamping collar has a shell surface profiled in the peripheral direction, which shell surface is designed to secure an accessory mounting device in a positive-locking manner in the peripheral direction. By a "shell surface profiled in the peripheral direction" should be understood, in particular, in this context that at least one outer contour of the clamping collar in a sectional view, perpendicular to the axial direction of the output shaft, deviates at least partially, preferably fully, from a circular outer contour. The outer contour of the shell surface of the clamping collar can be, in particular, of oval, polygonal, epicycloidal and/or star-shaped configuration. Other shapes of the outer contour of the clamping collar which appear sensible to a person skilled in the art are also conceivable. By virtue of the shell surface of the clamping collar, which shell surface is configured profiled in the peripheral direction, an anti-twist protection of the accessory mounting device in the peripheral direction can be achieved in an advantageously simple manner, wherein the accessory mounting device can be fastened to the clamping collar by the user of the hand-held machine tool preferably in at least two positions relative to the peripheral direction.

It is further proposed that the clamping collar has a shell surface which is profiled in the axial direction and which is designed to secure an accessory mounting device in a positive-locking manner in the axial direction. By a "shell surface profiled in the peripheral direction" should be understood in particular, in this context that at least one outer contour of the clamping collar in a sectional view, parallel to the axial direction of the output shaft, deviates from a straight line and has an elevation and/or a depression which transcends a pure material roughness and/or machining inaccuracy. The clamping collar preferably has a groove, which runs along the shell surface in the peripheral direction in a plane extending perpendicular to the axial direction of the output shaft. It is also conceivable to provide a projection which extends outwards from the shell surface of the clamping collar in a radial direction of the output shaft. By virtue of the shell surface of the clamping collar, which is configured profiled in the axial direction, an advantageously simple securement of the accessory mounting device to the clamping collar in at least one axial direction can be achieved.

In addition, the disclosure relates to an accessory mounting device, in particular to an accessory mounting device of a hand-held machine tool, which is designed to be fastened to a clamping collar of a hand-held machine tool and which has a fastening unit and at least one accessory coupling unit. By an "accessory coupling unit" should be understood, in particular, a region of the accessory mounting device which is specifically designed to receive an accessory element, and/or to secure it captively to the accessory mounting device. The accessory element can be formed, in particular, by an auxiliary handle, a spacer, a guide slide or a depth stop. Further embodiments of the accessory element which appear sensible to a person skilled in the art are conceivable. The accessory coupling unit can preferably comprise a holding element, which is designed to fasten an accessory element detachably to the accessory mounting device. By "detachably" should be understood, in particular, in this context "separably in a non-destructive manner". Particularly advantageously, the accessory element is detachable and/or fastenable without tools. It is also conceivable for the accessory coupling site to be formed by a region of the accessory fastening unit which is designed to receive the accessory element in an integrally bonded manner. The accessory element can here be welded, bonded and/or soldered to the site of the accessory fastening unit or be connected in one piece to the accessory mounting device.

It is proposed that the fastening unit has at least one clamping ring. By a "clamping ring" should be understood, in particular, in this context a component which is designed to be fastened to the clamping collar of the hand-held machine tool, preferably in a positive-locking and/or non-positive locking manner. To this end, the clamping ring can have, at least partially, a circular, oval, polygonal, epicycloidal and/or star-shaped inner contour, which limits a receiving region. Preferably, the inner contour of the clamping ring is configured complementary to the outer contour of the clamping collar. By virtue of the embodiment of the accessory mounting device with the clamping ring of the fastening unit, an advantageously simple fastening of the accessory element to the hand-held machine tool can be achieved. The clamping ring can preferably be formed of metal, whereby the clamping ring can be produced in an advantageously simple and cost-effective manner. It is also conceivable, however, to produce the clamping ring from a plastic, whereby further elements can also be formed onto the clamping ring in an advantageously simple manner.

Furthermore, it is proposed that the clamping ring is of resiliently elastic configuration. By "resiliently elastic" should be understood in this context that the clamping ring, counter to a spring force which is preferably applied by the clamping ring, deformed by an operator, can be expanded, preferably in the radial direction, in particular by more than 2 mm and preferably by more than 5 mm, and then automatically snapped back into an original shape. By virtue of the resiliently elastic embodiment of the clamping ring, the clamping ring can be fastened to the clamping collar of the hand-held machine tool by the user of the hand-held machine tool in an advantageously simple and uncomplicated manner. Alternatively or additionally, the clamping ring can also be clamped by at least one additional clamping element and thus be held in a non-positive locking manner on the clamping collar of the hand-held machine tool. The at least one clamping element can be formed by a clamping screw and/or preferably by a clamping lever. Other embodiments of the at least one additional clamping element which appear sensible to the person skilled in the art are also conceivable.

It is further proposed that the clamping ring is configured profiled in a peripheral direction. By "configured profiled in a peripheral direction" should be understood, in particular, in this context that at least one inner contour, in a top view of the clamping ring, deviates at least partially from a circular inner contour. The inner contour of the clamping ring can be, in particular, of oval, polygonal, epicycloidal and/or star-shaped configuration. Preferably, the inner contour of the clamping ring of the accessory fastening unit is at least substantially complementary to the outer contour of the peripherally profiled shell surface of the clamping collar of the hand-held machine tool. An anti-twist protection of the clamping ring of the accessory mounting device in the peripheral direction can thereby be achieved in an advantageously simple manner, wherein the clamping ring of the accessory mounting device can be fastened to the clamping collar by the user of the hand-held machine tool preferably in at least two positions relative to the peripheral direction.

In a further embodiment of the disclosure, it is proposed that the clamping ring is configured open in a radial direction. By "open" should be understood in this context that the clamping ring has ends which are spaced apart in the peripheral direction. Between the ends of the clamping ring in the radial direction, a passage can here be present, or the ends of the clamping ring can be arranged so as to overlap in the radial and/or axial direction. By virtue of the embodiment of the clamping ring, a simple fitting and/or removal can be achieved. The ease of operation for the user of the hand-held machine tool can thereby be advantageously enhanced. The embodiment of the clamping ring preferably enables the clamping ring to be deformed, in particular expanded, in an advantageously simple manner in the radial and peripheral direction, so that the clamping ring can be slipped onto the clamping collar of the hand-held machine tool in an advantageously simple manner in the axial or radial direction. The ease of operation for the user of the hand-held machine tool can thereby be enhanced in a particularly advantageous manner.

In addition, a system comprising a hand-held machine tool, comprising a first accessory mounting device and comprising at least one further accessory mounting device, which differs from the first accessory mounting device and which, additionally or alternatively to the first accessory fastening unit, can be fastened to the hand-held machine tool, is proposed. By virtue of the system disclosed herein, an advantageously high flexibility of the hand-held machine tool for the user of the hand-held machine tool can be achieved, whereby the ease of operation can be advantageously enhanced.

BRIEF DESCRIPTION OF THE DRAWINGS

Further advantages emerge from the following description of the drawing. In the drawing, two illustrative embodiments of the disclosure are represented. The drawing, the description and the claims contain numerous features in combination. The person skilled in the art will expediently view the features also in isolation and will combine them into sensible further combinations.

DETAILED DESCRIPTION

Figure 1:
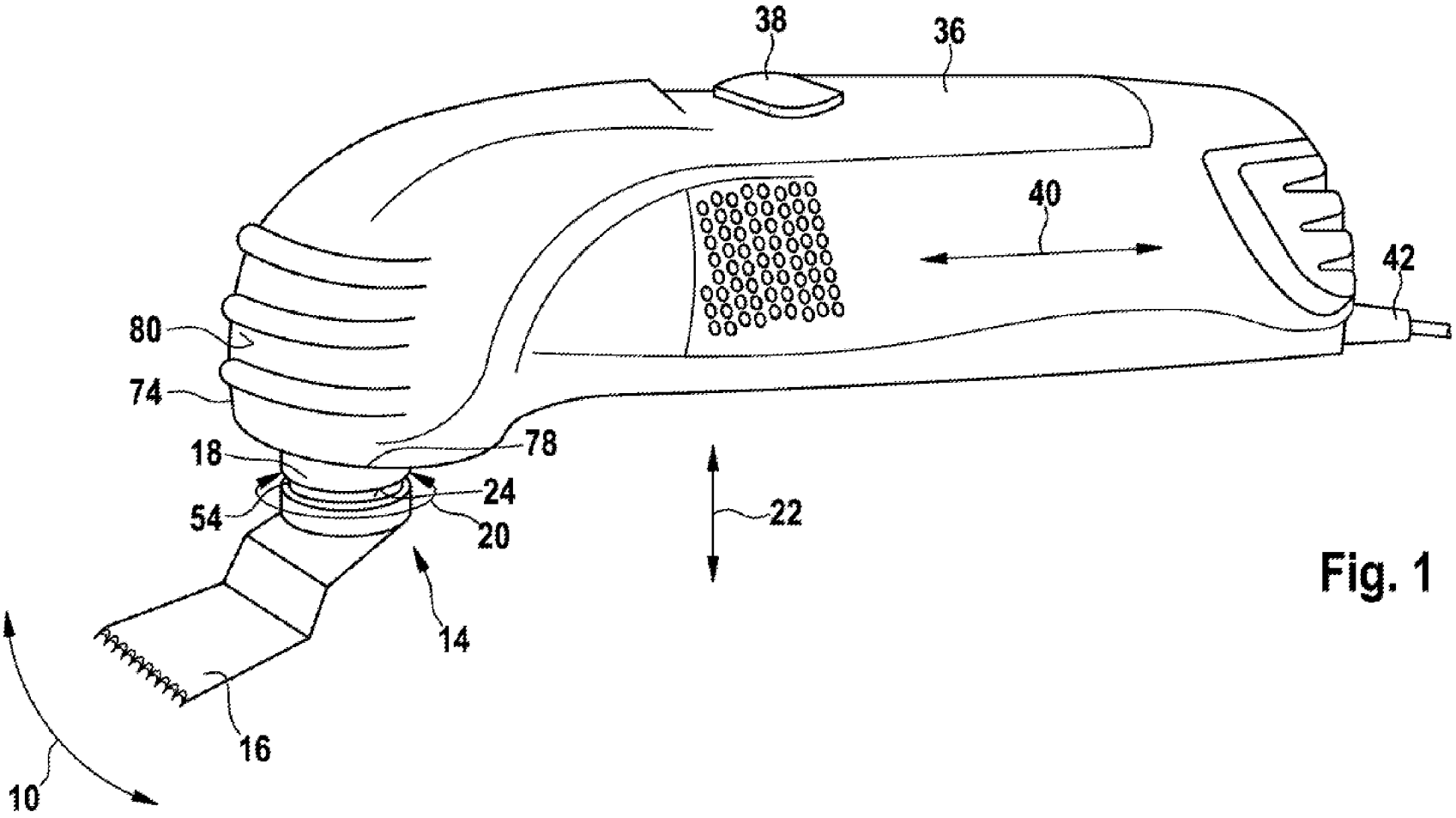
FIG. 1 shows a hand-held machine tool in a perspective side view.
Figure 5:
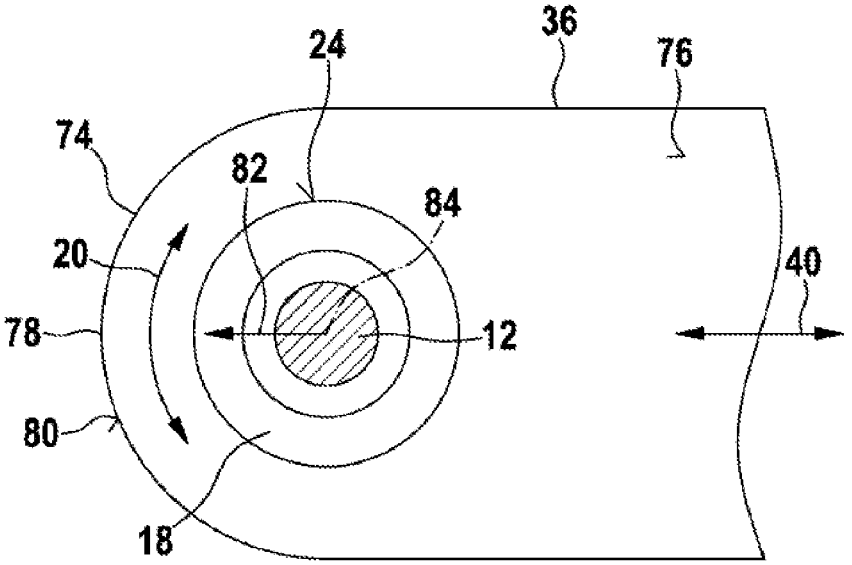
FIG. 5 shows a section along the line V-V in FIG. 4 in a schematic representation.

FIG. 1 shows a hand-held machine tool, which has a switch 38 for switching the hand-held machine tool on and off, which switch is integrated in a housing 36 of the hand-held machine tool that serves as a handle. At a front, machining-side-facing end 74 of the housing 36 of the hand-held machine tool, a clamping collar 18 extends perpendicular to a direction of principal extent 40 of the hand-held machine tool. The clamping collar 18 is disposed in a peripheral direction 20 around an output shaft 12 of the hand-held machine tool, parallel to the output shaft 12 of the hand-held machine tool. The clamping collar 18 is of circular-cylindrical configuration. A development of a shell surface 24 of the clamping collar 18 is formed by a rectangle. The clamping collar 18 extends from a bottom side 76 of the housing 36, perpendicular to the direction of principal extent 40 of the hand-held machine tool, to a tool holder 14 for the fastening of an insert tool 16. The bottom side 76 of the housing 36 extends at least partially along a plane running perpendicular to an axial direction 22 of the output shaft 12. The bottom side 76 fully encloses the clamping collar 18. The clamping collar 18 is disposed at a distance from an edge 78 by which an end face 80 of the end 74 of the hand-held machine tool passes into the bottom side 76 of the housing 36, in a direction of principal extent 40 of the housing 36 which is facing away from the machining side. The bottom side 76 of the housing 36 of the hand-held machine tool is disposed between an end face 80 of one end 74 of the hand-held machine tool and at least one point of intersection S of a shell surface 24 of the clamping collar 18 and a vector 82 which, starting from a rotational axis 84 of the output shaft 12, runs in the direction of the end face 80 parallel to the principal direction of extent 40 of the hand-held machine tool (FIG. 5).

At one end of the output shaft 12, which end protrudes from the housing 36 of the hand-held machine tool, is disposed the tool holder 14, with the insert tool 16 held therein. The tool holder can be driven in an oscillating manner by means of the output shaft 12 of the gearbox unit. In addition, the hand-held machine tool comprises a drive unit (not represented in detail), formed by an electric motor, and a gearbox unit (not represented in detail). The gearbox unit is designed to convert a rotary motion of the drive unit into an oscillating motion 10. The gearbox unit has the output shaft 12. In a region facing away from the tool holder 16 in the direction of principal extent 40 of the hand-held machine tool, the hand-held machine tool has a power cable 42 for supplying power to the drive unit.

Figure 2:
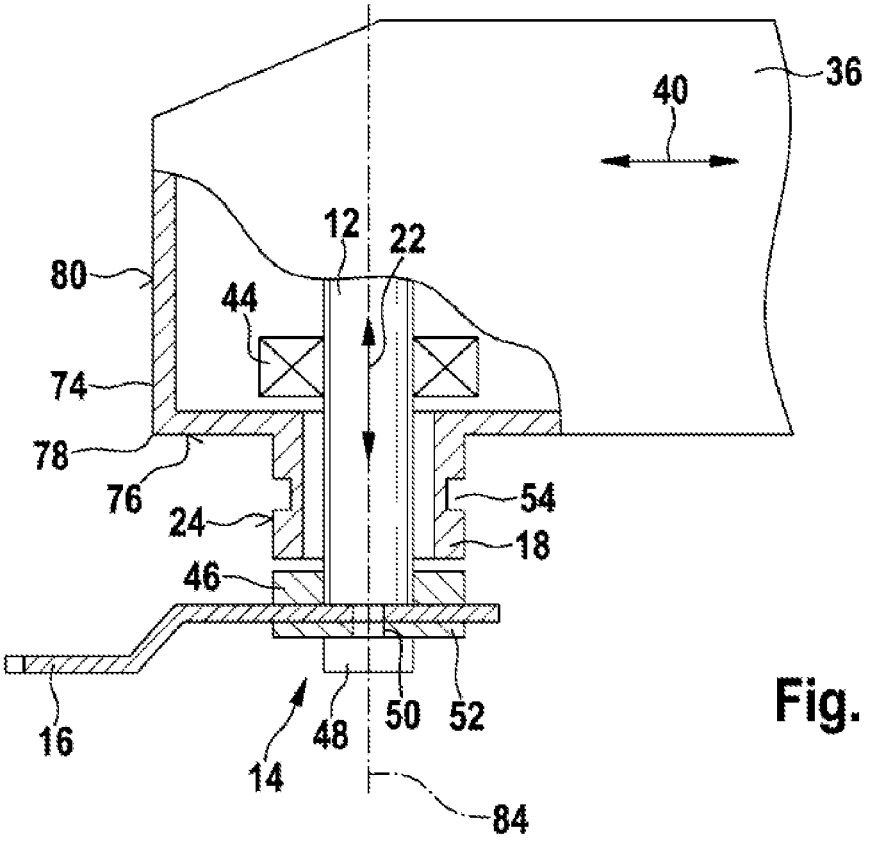
FIG. 2 shows a sub-region of the hand-held machine tool in a partially sectioned, schematic representation.

In FIG. 2, the front region of the hand-held machine tool is shown in a partially sectioned representation. The output shaft 12 is mounted rotatably in the housing 36 of the hand-held machine tool by means of a bearing 44. At one end of the output shaft 12, which end protrudes from the housing 36, is arranged the tool holder 14. The tool holder 14 comprises a supporting flange 46. The supporting flange 46 is pressed onto the output shaft 12. In a mounted state of the insert tool 16, the insert tool 16 is held by means of a fastening screw 48 in a non-positive locking manner on the supporting flange 46. The fastening screw 48 extends in the axial direction 22 of the output shaft 12 through an opening 50 in the insert tool 16 and is screwed into a threaded bore (not represented in detail) in the output shaft 12. The fastening screw 48 is supported in a mounted state, in the axial direction 22 on the insert tool 16, by means of a washer 52.

Between the housing 36 of the hand-held machine tool and the tool holder 14, the clamping collar 18 is arranged in the axial direction 22. The clamping collar 18 extends in a peripheral direction 20 fully around the output shaft 12 and is closed in the peripheral direction 20 and is of regular configuration. The clamping collar 18 is formed integrally onto the housing 36 of the hand-held machine tool. The clamping collar 18 has a length in the axial direction 22 of 10 mm. A diameter of the clamping collar 18 substantially corresponds to a diameter of the supporting flange 46. By "substantially" should be understood, in particular, in this context that a relative difference between the diameters of the clamping collar 18 and of the supporting flange 46 amounts, in particular, to less than 15%, preferably to less than 10%, and particularly preferably to less than 5% of the largest diameter. In addition, the clamping collar 18 has a shell surface 24 which is profiled in the axial direction 22 and which is designed to secure an accessory mounting device in a positive-locking manner in the peripheral direction 20. The profiling of the shell surface 24 is formed by a groove 54, which extends in the peripheral direction 20 of the clamping collar 18.

Figure 3:
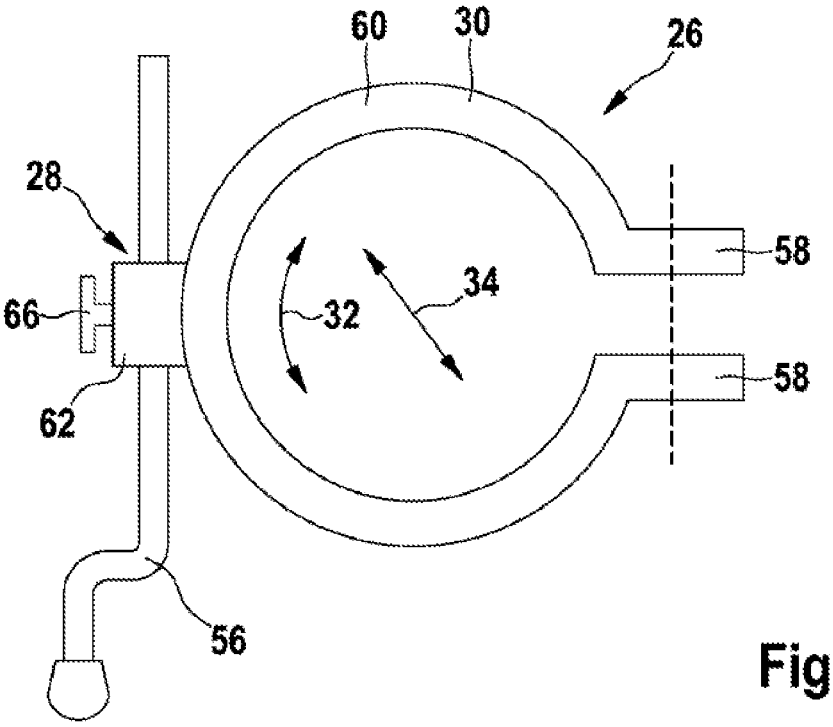
FIG. 3 shows an accessory mounting device in a schematic top view.

In FIG. 3, an accessory mounting device, with a thereto fastened accessory element 56 formed by a spacer, is represented. The accessory mounting device is designed to be fastened to the clamping collar 18 of the hand-held machine tool. The accessory mounting device has a fastening unit 26 and an accessory coupling unit 28. The fastening unit 26 comprises a clamping ring 30. The clamping ring 30 is configured open in a radial direction 34 of the clamping ring 30 and has a passage in the radial direction 34. The clamping ring 30 has two clamping extensions 58, which limit the passage of the clamping ring 30 in the peripheral direction 20. The clamping extensions 58 are formed integrally onto a circularly configured fastening region 60 of the clamping ring 30. The clamping extensions 58 extend in the radial direction 34 of the clamping ring 30 outwards from the fastening region 60. The two clamping extensions 58 are arranged parallel to each other. The clamping ring 30 is produced from a metallic material and is of resiliently elastic configuration.

In addition, the accessory mounting device has the accessory coupling unit 28. The accessory coupling unit 28 is disposed on a side of the clamping ring 30 facing away from the clamping extensions 58 and is connected in an integrally bonded manner to the clamping ring 30. The accessory coupling unit 28 is formed by a holding element 62. The holding element 62 has a mounting recess 64, which extends tangentially to a peripheral direction 32 of the clamping ring 30 and perpendicular to the clamping extensions 58. Into the mounting recess 64 of the holding element 62 can be inserted the 64 accessory element 56. The accessory element 62 is then fastened in the holding element 62, in a non-positive and/or positive locking manner, with an accessory fastening screw 66.

Figure 4:
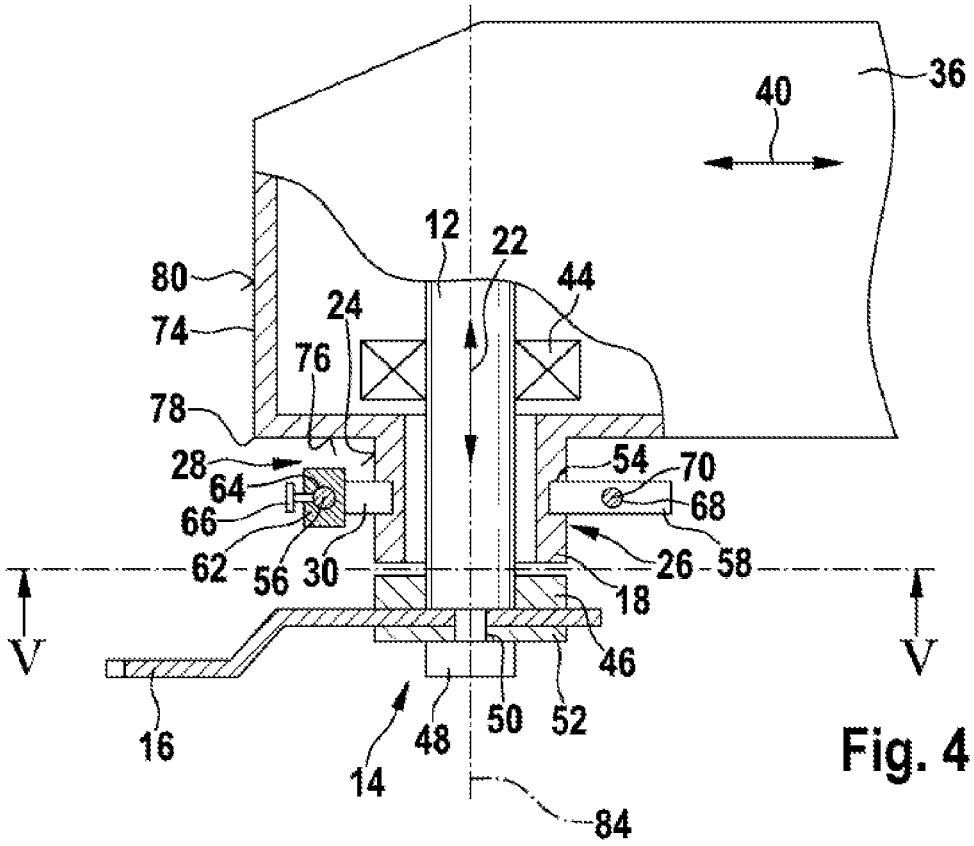
FIG. 4 shows a sub-region of the hand-held machine tool in a partially sectioned, schematic representation with the mounting device in a mounted state.

FIG. 4 shows the front region of the hand-held machine tool in a partially sectioned representation featuring the accessory mounting device fastened to the clamping collar 18 of the hand-held machine tool and featuring a thereto fastened accessory element 56. In an assembly operation, the clamping ring 30 of the fastening unit 26 of the accessory mounting device is expanded by the user of the hand-held machine tool in the peripheral direction 32 of the clamping ring 30 and, in the axial direction 22 from the tool holder 14 to the housing 36, is slipped onto the clamping collar 18 of the hand-held machine tool. The clamping ring 30 is slid on the clamping collar 18 of the hand-held machine tool in the axial direction 22 towards the housing 36. Once the clamping ring 30 reaches the groove 54, which is recessed in the peripheral direction 20 into the clamping collar 18 of the hand-held machine tool, the clamping ring 30 automatically snaps back into an original shape and engages in the groove 54 of the clamping collar 18. Once the clamping ring 30 is engaged in the groove 54 of the clamping collar 18, the user of the hand-held machine tool can rotate the accessory mounting device in the peripheral direction 20 into a chosen position. Once this position is reached, the user can fasten the clamping ring 30 of the accessory mounting device in the groove 54 of the clamping collar 18 in a non-positively locking manner. To this end, the clamping extensions 58 respectively have an opening 68, through which a user of the hand-held machine tool, in an engaged state of the accessory mounting device, can stick a clamping screw 70 in the axial direction 22. Onto an end of the clamping screw 70, which end is facing away from a screw head of the clamping screw 70, a corresponding clamping nut is now screwed and tightened. The clamping extensions 58 are pressed closer together by means of the clamping screw 70, and the clamping nut corresponding to the clamping screw, tangentially to the peripheral direction 20, 32 of the clamping collar 18 and of the clamping ring 30, so that the clamping ring 30, in the peripheral direction 20, 32, is clamped tightly into the groove 54 of the clamping collar 18 of the hand-held machine tool. A screw clamping joint of the clamping extensions 58 of the clamping ring 30 of the accessory mounting device, which screw clamping joint is formed by the clamping screw 70 and the clamping nut, is represented schematically in FIG. 3. After this, the insert tool is fastened in the tool holder 14.

In FIG. 5, a part of the hand-held machine tool is shown in a sectional view along the line V-V. The clamping collar 18 is disposed at a distance from the machining-side-facing end 74 of the housing 36 in the direction of principal extent 40, facing away from the machining side, of the housing 36. The bottom side 76 of the housing 36 of the hand-held machine tool fully encloses the clamping collar 18 in a region lying on the outside in the radial direction 34. In a region of the clamping collar 18 which lies on the inside in the radial direction 34 is arranged the output shaft 12. The shell surface 24 of the clamping collar 18 runs in the peripheral direction 20 fully around the output shaft 12. The clamping collar 18 runs parallel to the output shaft 12.

The clamping collar 18 is disposed at a distance from the machining-side-facing end 74 of the housing 36 in the direction of principal extent 40, facing away from the machining side, of the housing 36. The bottom side 76 of the housing 36 of the hand-held machine tool fully encloses the clamping collar 18 in a region lying on the outside in the radial direction 34. In a region of the clamping collar 18 which lies on the inside in the radial direction 34 is arranged the output shaft 12. The shell surface 24 of the clamping collar 18 runs in the peripheral direction 20 fully around the output shaft 12. The clamping collar 18 runs parallel to the output shaft 12.

Figure 6:
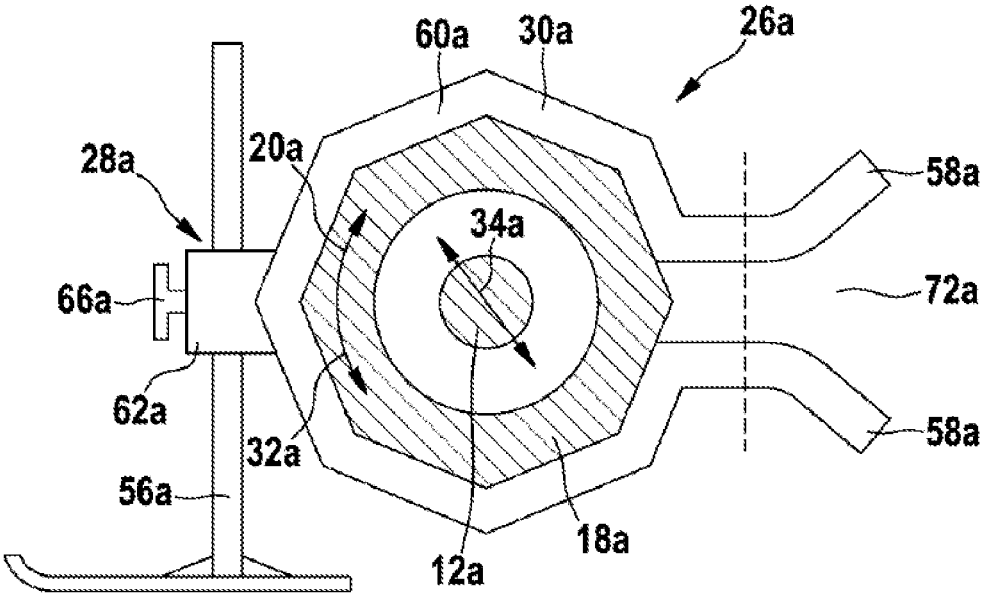
FIG. 6 shows a further illustrative embodiment of the mounting device in a mounted state on the hand-held machine tool in a schematic sectional view.

FIG. 6 shows an alternative embodiment of the accessory mounting device with an alternative, thereto fastened accessory element 56. Substantially mutually corresponding components and features are denoted basically with the same reference symbols, wherein, in order to differentiate between the illustrative embodiments, the letter a is in FIG. 6 added to the reference symbols. With respect to constant features and functions, furthermore, reference can be made to the description to the illustrative embodiments in FIGS. 1 to 5. The following description of FIG. 6 is substantially confined to the respective differences from the illustrative embodiment in FIGS. 1 to 5.

In FIG. 6, an alternatively configured accessory mounting device is represented. The accessory mounting device has a fastening unit **26*a* and an accessory coupling unit 28*a*. The fastening unit 26***a* comprises a clamping ring 30*a*. The clamping ring 30*a* has a fastening region 60*a*, which, in a peripheral direction 32*a*, is polygonally configured. The polygonally configured fastening region 60*a* of the clamping ring 30*a*, which fastening region is profiled in the peripheral direction 32*a*, is fastened in a positive and non-positively locking manner to a likewise polygonal clamping collar 18*a* of a hand-held machine tool, having an, in the peripheral direction 20*a*, profiled shell surface 24*a*, which clamping collar is represented in a sectional representation. In a radially inner region of the clamping collar 18*a* (shown in sectioned representation) of the hand-held machine tool, an output shaft 12*a* (likewise shown in sectioned representation) of a gearbox unit (not represented in detail) of the hand-held machine tool is shown. The clamping ring 30*a* is produced from a metallic material and is of resiliently elastic configuration.

The clamping ring 30*a* is configured open in a radial direction 34*a* of the clamping ring 30*a*. The clamping ring 30*a* has two clamping extensions 58*a*. The clamping extensions 58*a* are formed integrally onto the polygonally configured fastening region 60*a* of the clamping ring 30*a*. The clamping extensions 58*a* extend in the radial direction 34*a* of the clamping ring 30*a* outwards from the fastening region 60*a*. The clamping extensions 58*a* of the clamping ring 30*a*, in a first region facing the fastening region 60*a* of the clamping ring 30*a*, run parallel to each other. In a second region of the clamping extensions 58*a*, which region faces away from the fastening region 60*a* of the clamping ring 30*a*, the clamping extensions 58*a* run, diverging from each other, outwards in a curved line. This second region of the clamping extensions 58*a* forms a guide region 72*a*. In an assembly operation, the clamping ring 30*a* of the fastening unit 26*a* of the accessory mounting device can be slipped onto the clamping collar 18*a* of the hand-held machine tool in the radial direction 34*a*. A force in the radial direction 34*a*, which force is applied by a user, is diverted into a force running tangentially to a peripheral direction 20*a*. This force running tangentially to a peripheral direction 20*a* effects a resiliently elastic deflection of the clamping extensions 58*a*, and thus an expansion of the clamping ring 30*a* in the peripheral direction 32*a*. Extending through the first, mutually parallel running regions of the clamping extensions 58*a*, in a mounted state of the accessory mounting device on the clamping collar 18*a* of the hand-held machine tool, is a screw clamping joint (here represented schematically). By means of the screw clamping joint, the user can secure the clamping ring 30*a* of the accessory mounting device in a non-positive locking manner to the clamping collar 18*a* of the hand-held machine tool.

The accessory mounting device further has an accessory coupling unit 28*a*. The accessory coupling unit 28*a* is disposed on a side of the clamping ring 30*a* that is facing away from the clamping extensions 58*a* and is connected in an integrally bonded manner to the clamping ring 30*a*. The accessory coupling unit 28*a* has a holding element 62*a*. The holding element 62*a* has a mounting recess 64*a*, which extends tangentially to the peripheral direction 32*a* of the clamping ring 30*a* and perpendicular to the clamping extensions 58*a*. Into the mounting recess 64*a* can be inserted an accessory element 56*a*, which is here alternatively formed by a guide slide. The accessory element 56*a* is then fastened in a non-positive locking manner in the holding element 62*a* with an accessory fastening screw 66*a*.

The invention claimed is:

1. Accessory mounting device of a hand-held machine tool, comprising:

a fastening unit including a cylindrical clamping ring having a circumference and defining a radial direction extending to and intersecting said circumference; and at least one accessory coupling unit integral with said clamping ring at the intersection of said radial direction and said circumference of said clamping ring and including a holding element for receiving an accessory therethrough in a direction perpendicular to the radial direction at the intersection of said radial direction and said circumference and a fastening element for fastening the accessory to said holding element, wherein the hand-held machine tool includes (i) a housing including a machining-side-facing end in a direction of principal extent of the housing, (ii) a drive unit, (iii) a gearbox unit disposed within said housing and configured to convert a rotary motion of the drive unit into an oscillating motion, the gearbox unit having an output shaft extending perpendicular to the direction of principal extent of the housing, (iv) a tool holder configured to fasten at least one insert tool, and further configured to be driven in an oscillating manner via the output shaft of the gearbox unit, and (v) a cylindrical clamping collar extending from said housing and configured to extend away from the machining-side-facing end and at least partially around the output shaft in a peripheral direction, the clamping collar defining a continuous circumferential groove, wherein the accessory mounting device is configured to be fastened by the fastening unit to the clamping collar of the hand-held machine tool, wherein the clamping ring is sized to be received entirely within said continuous circumferential groove, and wherein the holding element and the fastening element are configured to permit adjustment of the accessory in said direction perpendicular to the radial direction at the intersection of said radial direction and said circumference.

2. Accessory mounting device according to claim 1, wherein the clamping collar, in a longitudinal direction of the output shaft, has a length of at least 3 mm.

3. Accessory mounting device according to claim 1, wherein:

the clamping collar has a shell surface profiled in the peripheral direction, and the shell surface is configured to secure the accessory mounting device in a positive-locking manner in the peripheral direction.

4. Accessory mounting device according to claim 1, wherein:

the clamping collar has a shell surface which is profiled in a longitudinal direction of the output shaft, and the shell surface is configured to secure the accessory mounting device in a positive-locking manner in the longitudinal direction.

5. Accessory mounting device according to claim 1, wherein the clamping ring is of resiliently elastic configuration.

6. Accessory mounting device according to claim 1, wherein the clamping ring is profiled in a peripheral direction.

7. Accessory mounting device according to claim 1, wherein the clamping ring is open in a radial direction.

* * * * *